US007124740B2

(12) United States Patent
Nomura et al.

(10) Patent No.: US 7,124,740 B2
(45) Date of Patent: Oct. 24, 2006

(54) FUEL INJECTION CONTROL DEVICE FOR INTERNAL COMBUSTION ENGINE

(75) Inventors: Mitsuhiro Nomura, Toyota (JP); Yasumichi Inoue, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/235,360

(22) Filed: Sep. 27, 2005

(65) Prior Publication Data

US 2006/0081219 A1 Apr. 20, 2006

(30) Foreign Application Priority Data

Oct. 18, 2004 (JP) ..... 2004-302429

(51) Int. Cl.
*F02D 41/14* (2006.01)
*F02D 41/38* (2006.01)

(52) U.S. Cl. ..... 123/458; 123/497

(58) Field of Classification Search ..... 123/364, 123/495, 379, 676, 696, 690, 357, 446, 456, 123/467, 198 D, 458, 497; 701/102, 114; 73/117.3, 118.1, 119 A, 116
See application file for complete search history.

(56) References Cited

U.S. PATENT DOCUMENTS

| | | | | |
|---|---|---|---|---|
| 6,450,147 | B1 * | 9/2002 | Demura et al. | 123/458 |
| 6,474,294 | B1 * | 11/2002 | Yamazaki et al. | 123/295 |
| 6,715,470 | B1 * | 4/2004 | Takahashi | 123/458 |
| 6,840,228 | B1 * | 1/2005 | Yomogida et al. | 123/494 |

FOREIGN PATENT DOCUMENTS

| | | |
|---|---|---|
| JP | A 2000-205018 | 7/2000 |
| JP | A 2000-282927 | 10/2000 |
| JP | A 2001-263144 | 9/2001 |

* cited by examiner

*Primary Examiner*—Andrew M. Dolinar
*Assistant Examiner*—Johnny H. Hoang
(74) *Attorney, Agent, or Firm*—Oliff & Berridge, PLC

(57) ABSTRACT

In feedback control of a discharge amount of a high pressure fuel pump in which an actual fuel pressure is caused to become a target fuel pressure, when a deviation between the target fuel pressure and the actual fuel pressure has transiently changed, updating of an integral term of the feedback control is stopped. As a result, needless updating of the integral term when the deviation of the target fuel pressure and the actual fuel pressure has transiently increased is inhibited, and fuel pressure overshoot is reliably suppressed.

8 Claims, 7 Drawing Sheets

FUEL INJECTION CONTROL DEVICE FOR INTERNAL COMBUSTION ENGINE

INCORPORATION BY REFERENCE

The disclosure of Japanese Patent Application No. 2004-302429 filed on Oct. 18, 2004 including the specification, drawings and abstract is incorporated herein by reference in its entirety.

BACKGROUND OF THE INVENTION

1. Field of the Invention

The invention relates to a fuel injection control device for a direct injection internal combustion engine in which fuel is directly injected into a combustion chamber.

2. Description of the Related Art

In a direct in-cylinder injection internal combustion engine in which fuel is directly injected into a combustion chamber, generally, fuel is pressurized by a high pressure fuel pump and supplied to a fuel injection valve. Fuel pressure is increased to a value (a target fuel pressure) at which it is possible to perform fuel injection since the fuel pressure is higher than a pressure within the combustion chamber.

In this type of fuel pressure control, a controlled variable is calculated based on a deviation between an actual fuel pressure in a fuel pipe and a target fuel pressure. The fuel pressure control is then carried out by performing feedback control of a fuel discharge amount (pump duty) of a high pressure fuel pump in accordance with the controlled variable such that the actual fuel pressure converges on the target fuel pressure. The above mentioned controlled variable used in drive control of the high pressure fuel pump is calculated using (a) an integral term that is updated in accordance with the deviation between the target fuel pressure and the actual fuel pressure, (b) a proportional term that increases and decreases in order to make the deviation between the actual fuel pressure and the target fuel pressure zero, and the like.

In feedback control of the high pressure fuel pump of this kind, when the internal combustion engine is driven at high rotational speeds, fuel pressure overshoot occurs when a cycle of a discharge stroke is shorter than a calculation cycle of the discharge amount control of the high pressure fuel pump. In one suggested method for solving this problem (refer to Japanese Patent Laid-open Publication No. 2000-282927), overshoot of the actual fuel pressure is suppressed by setting feedback gain to be smaller at high rotational speeds when the cycle of the discharge stroke of the high pressure fuel pump is short.

In fuel injection control of the direct injection internal combustion engine, if the fuel pressure is low despite a required fuel injection amount being large when the internal combustion engine starts or the like, the fuel discharge amount of the high pressure fuel pump is set to a value near to a maximum value thereof, and the fuel pressure is rapidly increased toward the target fuel pressure. At this time, even if the integral term for increasing the fuel pressure is set larger, the fuel discharge amount does not increase. As a result, the fuel pressure does not increase rapidly and the integral term is mistakenly set to an excessively high value. After the actual fuel pressure has exceeded and increased beyond the target fuel pressure, the value of the integral term starts to decrease. However, since the reduction in the value of the integral term takes place slowly, the value of the integral term is mistakenly excessively large. Accordingly, after the actual fuel pressure has reached the target fuel pressure, the controlled variable for controlling the fuel discharge amount of the high pressure fuel pump causes the fuel discharge amount to deviate to an amount that is too large as compared to the required value. Thus, overshoot occurs in which the fuel pressure exceeds and increases beyond the target fuel pressure, which may lead to problems such as deterioration in a combustion condition of the internal combustion engine.

As one approach to solving this type of problem, a method has been proposed for inhibiting the occurrence of overshoot in which updating of an integral term is prohibited when a fluid discharge amount of a high pressure fuel pump is near to the maximum value thereof (for example, Japanese Patent Laid-open Publication No. 2001-263144). As a result, it is possible to avoid the fuel discharge amount being change excessively to too large an amount due to mistaken setting of the integral term.

Further, another method has been suggested in which, as a method for maintaining favorable fuel pressure control responsiveness in feedback control of a high pressure fuel pump, when an actual fuel pressure is higher than a target fuel pressure during a fuel cut, updating of an integral term of the feedback control is prohibited (refer to, for example, Japanese Patent Laid-open Publication No. 2000-205018).

However, in the fuel injection control of the internal combustion engine, if a change amount of the target fuel pressure is changed rapidly causing the deviation between the target fuel pressure and the actual fuel pressure to transiently become larger, the actual fuel pressure is caused to track the target fuel pressure due to addition of the proportional term and the integral term in the feedback control. Even if the pump duty is calculated using the target fuel pressure and the actual fuel pressure, there is a delay before when the high pressure fuel pump is actually driven and the fuel discharged. If the timing of the next pump duty calculation occurs during this delay, the integral term increases during the delay. As a result, overshoot occurs in which the actual fuel pressure exceeds and increases beyond the target fuel pressure, whereby the combustion condition of the internal combustion engine may deteriorate.

Moreover, in the direct injection internal combustion engine, a fuel injection cycle is set to be shorter than the discharge stroke cycle of the high pressure fuel pump. Accordingly, even if the target fuel pressure is constant, if the actual fuel pressure has reduced substantially due to load variation, the load variation (the reduction in the actual fuel pressure) cannot be included in the next pump duty calculation. In this case, the deviation between the actual fuel pressure and the target fuel pressure becomes larger, and overshoot occurs in which the integral term of the feedback control increases.

The above described patent publications do not take into consideration this type of overshoot that occurs when the target fuel pressure, the load, or the like, change transiently. Further, this problem cannot be solved by methods like those disclosed in these patent publication, namely, the method in which feedback gain is set smaller at high rotational speeds, or the methods in which updating of the integral term is prohibited when (a) the fuel discharge amount of the high pressure fuel pump is near to the maximum value thereof or (b) the actual fuel pressure is higher than the target fuel pressure during a fuel cut.

Note that, in order to inhibit the pump duty from becoming less than 0% or larger than 100% in the fuel injection control of the direct injection internal combustion engine, art has been disclosed that performs processing in which the pump duty is guarded using an upper-lower limit guard (for example, Japanese Patent Laid-open Publication No. 2001-263144). With this upper-lower limit guard processing, even when the pump duty is being guarded, the integral term of the feedback control is updated. Thus, when a pump duty DT satisfies, 0%<DT<100%, overshoot of the fuel pressure may occur.

SUMMARY OF THE INVENTION

An embodiment of the invention aims to solve the above described problem that occurs when deviation of a target fuel pressure and an actual fuel pressure transiently becomes larger when there is a delay between calculation of a pump duty and fuel discharge. It is an object of the invention to provide a fuel injection control device for an internal combustion engine that enables fuel pressure overshoot to be suppressed by inhibiting an integral term used in feedback control from being needlessly updated when, for example, the target fuel pressure, a load factor, or the like, have transiently changed.

According to an embodiment of the invention, a fuel injection control device for an internal combustion engine performs feedback control of a discharge amount of a high pressure fuel pump such that an actual fuel pressure becomes a target fuel pressure. The feedback control uses a control operation including an integral term. This fuel injection control device is characterised by including integral term update control means for stopping update of the integral term of the feedback control when a deviation of the target fuel pressure and the actual fuel pressure is equal to or more than a predetermined value. More specifically, the integral term update means may stop updating of the integral term of the feedback control when at least one of a change amount of the target fuel pressure is equal to or more than a predetermined value, and a change amount of a load factor of the internal combustion engine is equal to or more than a predetermined value.

According to the embodiment of the invention, updating of the integral term of the feedback control is stopped when a transient change has occurred in which the deviation between the target fuel pressure and the actual fuel pressure has become equal to or more than the predetermined value due to a sudden change in the target fuel pressure or the load factor. Accordingly, even in the case that the target fuel pressure, the load factor, or the like, has transiently changed, the integral term can be inhibited from being needlessly updated and fuel pressure overshoot can be suppressed.

In the embodiment of the invention the timing of the return to updating of the integral term of the feedback control takes into consideration a delay between when a pump duty that is a controlled variable of the feedback control is calculated and when fuel discharge takes place. Accordingly, the return to updating of the integral term takes place when the fuel discharge can be controlled using the integral term. More concretely, calculation means for calculating the pump duty based upon the deviation of the target fuel pressure and the actual fuel pressure is provided. After it has been determined that the deviation between the target fuel pressure and the actual fuel pressure is equal to or more than the predetermined value (the change amount of the target fuel pressure or the change amount of the load factor is equal to or above the respective predetermined value), the integral term update determination control means returns to updating of the integral term of the feedback control after completion of the fuel discharge in accordance with the pump duty based on the deviation of the actual fuel pressure and the target fuel pressure.

In the embodiment of the invention, the integral term of the feedback control may be stopped from being updated when the pump duty is 0% or 100%. When this configuration is adopted, in the case that the pump duty is guarded by upper-lower limit guard processing like that described above, when the pump duty is equal to an upper limit value (100%) or a lower limit value (0%) of a guard, needless updating of the integral term is inhibited. Accordingly, fuel pressure overshot can be reduced.

According to the embodiment of the invention, in feedback control of the discharge amount of the high pressure fuel pump in which the actual fuel pressure is caused to become the target fuel pressure, when a transient change has occurred in which the deviation between the target fuel pressure and the actual fuel pressure has become equal to or more than the predetermined value, updating of an integral term of the feedback control is stopped. Accordingly, it is possible to solve the problem that increase in the integral term occurs if the deviation between the target fuel pressure and the actual fuel pressure has changed transiently when there is a delay between when the pump duty is calculated and when fuel discharge takes place. As a result, fuel pressure overshoot can be reliably suppressed. Thus, even if the deviation of the target fuel pressure and the actual fuel pressure has become transiently larger, it is possible to favorably maintain the combustion condition of the engine.

DETAILED DESCRIPTION OF THE PREFERRED EMBODIMENTS

Hereinafter, a direct injection multi-cylinder (four cylinder) gasoline engine to which the invention is applied will be explained with reference to FIGS. 1 to 3.

Figure 2:
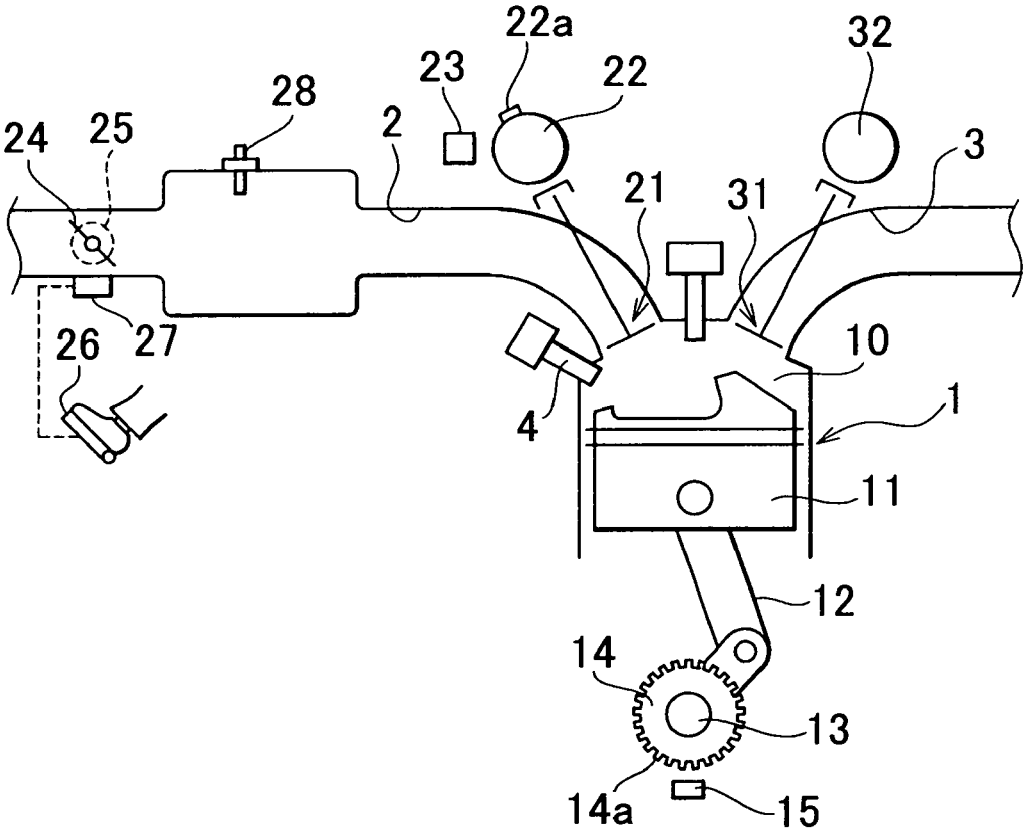
FIG. 2 shows a schematic configuration of an in-cylinder direct injection gasoline engine.

Engine:

The configuration of an engine 1 to which the invention is applied is shown in FIG. 2. Note that, FIG. 2 only shows the configuration of one cylinder of the engine 1.

The engine 1 shown in FIG. 2 includes a piston 11 that forms a combustion chamber 10, and a crank shaft 13 that is an output shaft. The piston 11 is connected to the crank shaft 13 using a connecting rod 12. Reciprocal movement of the piston 11 is converted to rotation of the crank shaft 13 by the connecting rod 12.

A signal rotor 14 with a plurality of protrusions 14*a* on an outer peripheral surface thereof is attached to the crankshaft 13. A crank position sensor 15 is positioned in the vicinity of a side of the signal rotor 14. When the crank shaft 13 rotates, the crank position sensor 15 outputs a pulse signal that corresponds to the protrusions 14*a* of the signal rotor 14.

An intake passage 2 and an exhaust passage 3 are connected to the combustion chamber 10 of the engine 1, and an intake valve 21 is provided between the intake passage 2 and the combustion chamber 10. The intake valve 21 is opened and closed to allow communication or block communication of the intake passage 2 and the combustion chamber 10. Further, an exhaust valve 31 is provided between the exhaust passage 3 and the combustion chamber 10. The exhaust valve 31 is opened and closed to allow communication or block communication of the exhaust passage 3 and the combustion chamber 10. The intake valve 21 and the exhaust valve 31 are driven to open and close by the respective rotations of an intake cam shaft 22 and an exhaust cam shaft 32 to which rotation of the crankshaft 13 is transmitted.

A protrusion 22*a* is formed in the intake cam shaft 22, and a cam position sensor 23 is positioned in the vicinity of a side of the intake cam shaft 22. The cam position sensor 23 outputs a detection signal each time the protrusion 22*a* passes by the vicinity of the cam position sensor 23 along with rotation of the intake cam shaft 22.

A throttle valve 24 that regulates an intake air amount of the engine 1 is disposed in an upstream portion of the intake passage 2, and is driven by a throttle motor 25. An opening degree of the throttle valve 24 is adjusted based on drive and control of the throttle motor 25 in accordance with a depression operation of an accelerator pedal 26 that is located in a passenger compartment of the vehicle. A depression amount (accelerator depression amount) of the accelerator pedal 26 is detected by an accelerator position sensor 27. Further, a vacuum sensor 28 that detects a pressure (intake pressure) within the intake passage 2 is positioned on the downstream side of the throttle valve 24

A fuel injection valve 4 that directly injects fuel into the combustion chamber 10 is provided in each cylinder of the engine 1. The fuel injection valve 4 of each cylinder supplies high pressure fuel using a fuel supply device 100, described later. Fuel from each fuel injection valve 4 is directly injected into each combustion chamber 10, whereby an air-fuel mixture containing air and fuel is formed in the combustion chamber 10. This air-fuel mixture is combusted within the combustion chamber 10, thereby causing the piston 11_to move reciprocally and the crankshaft 13 to rotate.

Fuel Supply Device

Figure 1:
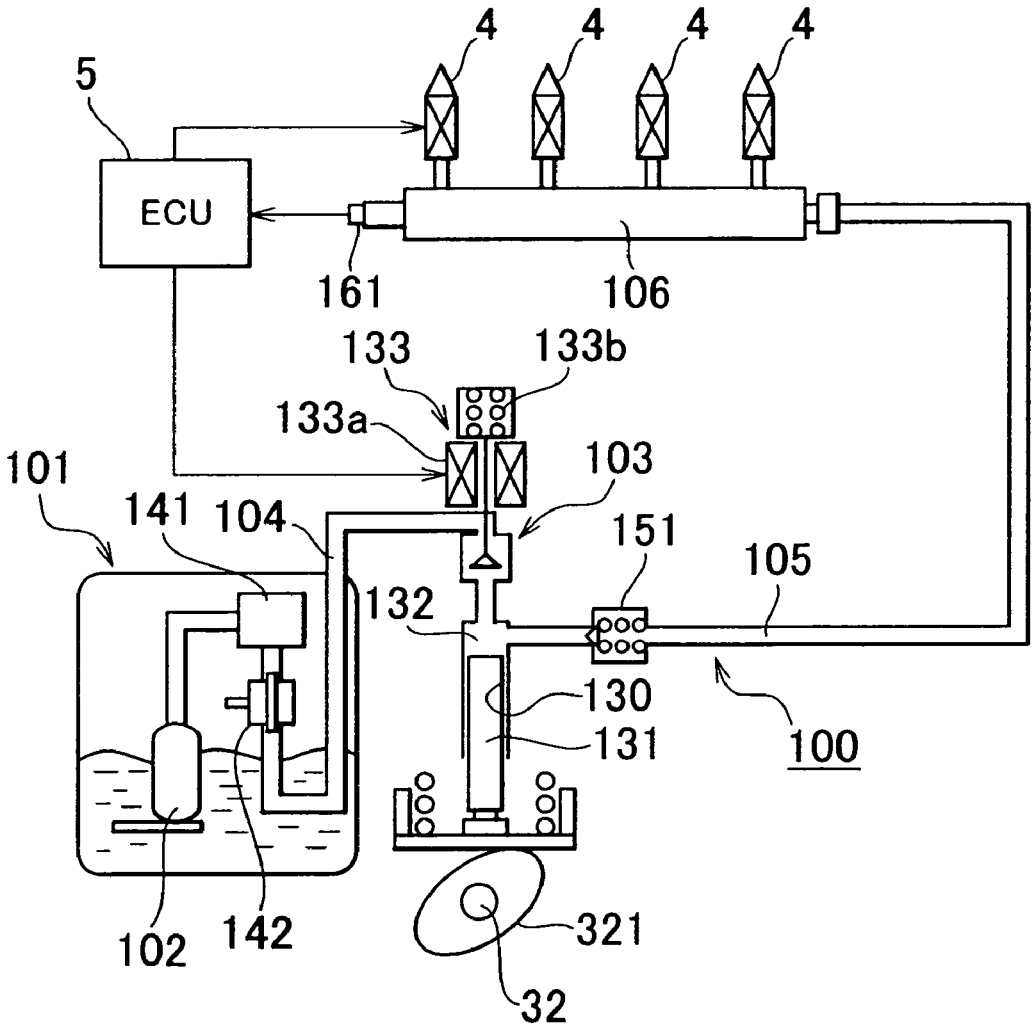
FIG. 1 shows a schematic configuration of an example of a fuel supply device of an engine to which a fuel injection control device of the invention is applied.

FIG. 1 shows a schematic configuration of the fuel supply device 100.

This example of the fuel supply device 100 includes: a feed pump 102 that feeds fuel from a fuel tank 101; and a high pressure fuel pump 103 that pressurizes the fuel fed from the feed pump 102 and discharges it toward each fuel injection valve 4 of each cylinder (four in this case).

The high pressure fuel pump 103 is provided with a cylinder 130, a plunger 131, a pressurization chamber 132, and a solenoid spill valve 133. The plunger 131 is driven by rotation of a cam 321 that is attached to the exhaust cam shaft 32, and moves reciprocally within the cylinder 130. As the plunger 131 moves reciprocally, the volume of the pressurization chamber 132 is increased and decreased.

The pressurization chamber 132 is defined by the plunger 131 and the cylinder 130. Communication between the pressurization chamber 132 and the feed pump 102 is provided by a low pressure fuel passage 104. Further, communication is provided between the pressurization chamber 132 and an inside of a delivery pipe 106 by a high pressure fuel passage 105. The respective fuel injection valves 4 are connected to the delivery pipe 106. A fuel pressure sensor 161 is disposed in the delivery pipe 106 and detects a fuel pressure (an actual fuel pressure) therein.

A filter 141 and a plunger regulator 142 are provided in the low pressure fuel passage 104. Further, a check valve 151 is provided in the high pressure fuel passage 105 and inhibits back flow of the fuel discharged from the high pressure fuel pump 103.

A solenoid spill valve 133 is provided in the high pressure fuel pump 103. The solenoid spill valve 133 provides allow communication and block communication between the low pressure fuel passage 104 and the pressurization chamber 132. The solenoid spill valve 133 is provided with a magnetic solenoid 133*a*. Current flowing to the magnetic solenoid 133*a* is controlled to activate the solenoid spill valve 133 to open and close. When the flow of current to the solenoid 133*a* is stopped, the solenoid spill valve 133 is opened by elastic force of a compression coil spring 133*b*. Next, the opening and closing operation of the solenoid spill valve 133 will be explained in detail with reference to FIG. 3.

First, when the flow of current to the magnetic solenoid 133*a* is stopped, the solenoid spill valve 133 is opened by elastic force of the compression coil spring 133*b*. Accordingly, there is communication between the low pressure fuel passage 104 and the pressurization chamber 132. In this state, when the plunger 131 is moved in a direction that increases the volume of the pressurization chamber 132 (an intake stroke), fuel fed from the feed pump 102 is sucked in to pressurization chamber 132 through the low pressure fuel passage 104.

On the other hand, when the plunger 131 is moved in a direction that reduces the volume of the pressurization chamber 132 (a discharge stroke), flow of current to the magnetic solenoid 133*a* causes the solenoid spill valve 133 to close in resistance to the elastic force of the compression coil spring 133*b*. Accordingly, communication between the low pressure fuel passage 104 and the pressurization chamber 132 is blocked, and the fuel within the pressurization chamber 132 is discharged in to the delivery pipe 106 through the high pressure fuel passage 105.

Regulation of a fuel discharge amount of the high pressure fuel pump 103 is performed by controlling a valve close start time of the solenoid spill valve 133 so as to regulate a valve closed period of the solenoid spill valve 133 in the discharge stroke. More specifically, when the valve close start time of the solenoid spill valve 133 is advanced, the valve closed period is made longer such that the fuel discharge amount increases. On the other hand, when the valve close start time is retarded, the valve closed period is made shorter such that the fuel discharge amount decreases. By regulating the fuel discharge amount of the high pressure fuel pump 103 in this way, it is possible to control the fuel pressure within the delivery pipe 106.

Next, a pump duty DT will be described that is a controlled variable used for control of the fuel discharge amount of the high pressure fuel pump 103 (i.e., the valve close start time of the solenoid spill valve 133).

The pump duty DT is a value that changes between the values of 0 and 100%, and has a relationship with a cam angle of the cam 321 of the exhaust cam shaft 32 that corresponds with the valve closed period of the solenoid spill valve 133.

The relationship of the pump duty DT and the cam angle of the cam 321 will be explained in detail with reference to FIG. 3. If the cam angle corresponding to a maximum valve closed period of the solenoid spill valve 133 (a maximum cam angle) is taken as $\theta_0$, and a cam angle corresponding to a target fuel pressure for the maximum valve closed period (a target cam angle) is taken as $\theta$, the pump duty DT is expressed by the ratio of the target cam angle $\theta$ with respect to the maximum cam angle $\theta_0$ (namely, $DT=\theta/\theta_0$). Accordingly, the pump duty DT has a value close to 100% when the target valve closed period (the valve close start time) of the solenoid spill valve 133 approaches close to the maximum closed valve period; and is a value close to 0% when the target valve closed period approaches near to zero.

Figure 4:
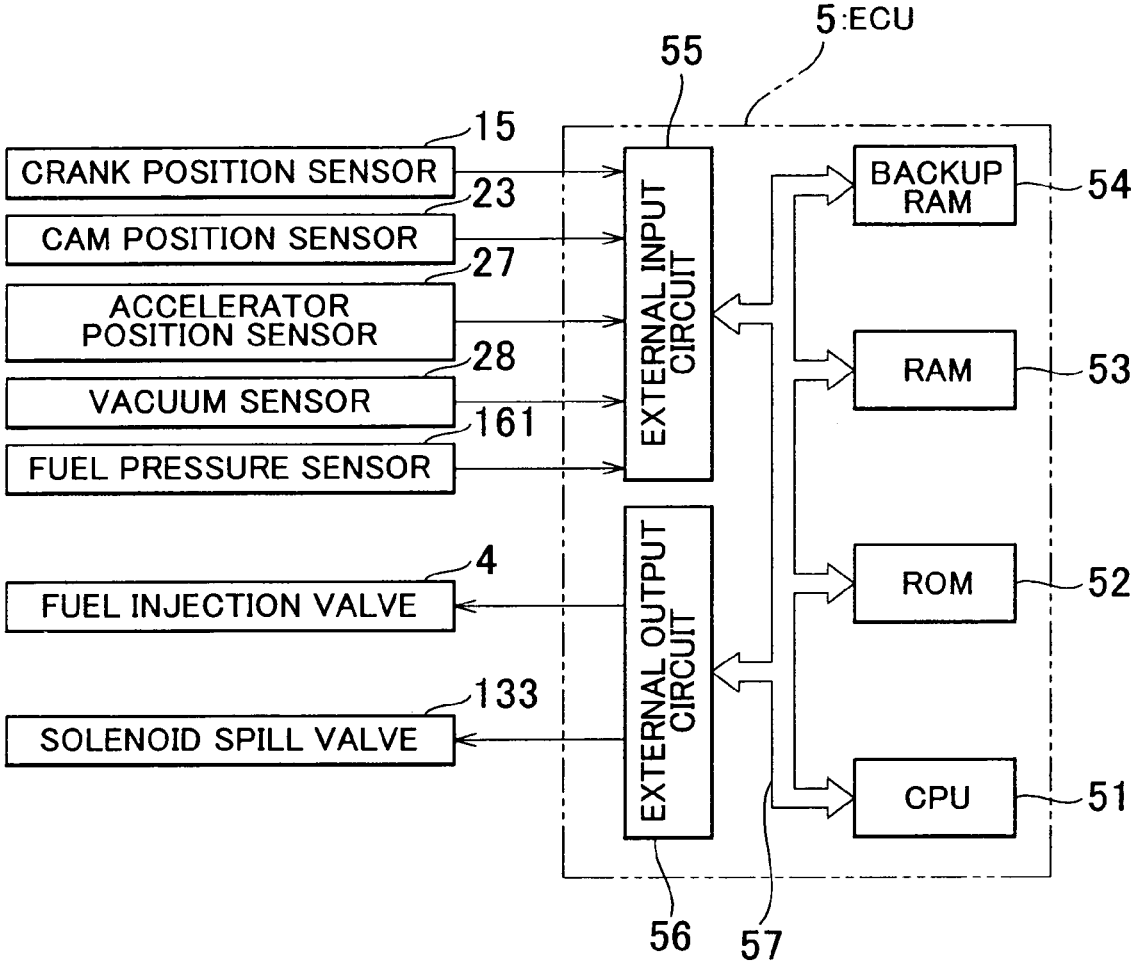
FIG. 4 is a block chart showing an example of a control system of the fuel injection control device of the invention.

As the value of the pump duty DT approaches close to 100%, the valve close start time of the solenoid spill valve 133 regulated based on the pump duty DT is advanced, whereby the valve closed period of the solenoid spill valve 133 becomes longer. As a result, the fuel discharge amount of the high pressure fuel pump 103 is increased such that the actual fuel pressure increases. On the other hand, as the value of the pump duty DT approaches close to 0%, the valve close start time of the solenoid spill valve 133 regulated based on the pump duty DT is retarded, whereby the valve closed period of the solenoid spill valve 133 is made shorter. Accordingly, the fuel discharge amount of the high pressure fuel pump 103 is reduced such that the actual fuel pressure decreases Fuel Injection Control Device FIG. 4 is a block chart showing an example of a control system of a fuel injection control device of the invention.

This example of the fuel injection control device includes an Electronic Control Unit (ECU) 5 that controls an engine operating state of the engine 1. The ECU 5 has a CPU 51, a ROM 52, a RAM 53, a backup RAM 54, etc.

The ROM 52 stores various control programs, maps that are referred to when executing the various control programs, and the like. The CPU 51 performs calculation processing based on the various control programs and the maps stored in the ROM 52.

The RAM 53 is a memory that temporarily stores calculation results of the CPU 51, data input from various sensors, and so on. The backup RAM 54 is a non-volatile memory that stores data that needs to be retained when the engine 1 is stopped. Further, the ROM 52, the CPU 51, the RAM 53 and the backup RAM 54 are interconnected by a bus 57, and are connected to an external input circuit 55 and an external output circuit 56.

The crank position sensor 15, the cam position sensor 23, the acceleration position sensor 27, the vacuum sensor 28, and the fuel pressure sensor 161, etc. are connected to the external input circuit 55. On the other hand, the fuel injection valve 4 and the solenoid spill valve 133, etc., are connected to the external output circuit 56

The ECU 5 calculates a final fuel injection amount Qfin that is used to control a fuel amount that is injected from the fuel injection valve 4 based on an engine rotation number NE, a load factor KL, and the like.

The engine revolution number NE is derived using a detection signal of the crank position sensor 15. Further, the load factor KL is a value that indicates a ratio of a present load with respect to a maximum engine load of the engine 1. The load factor KL is derived using a parameter corresponding to the intake air amount of the engine 1 and the engine rotation number NE. For the parameter corresponding to the intake air amount, it is possible to use, for example, an intake pressure PM derived using a detection signal of the vacuum sensor 28, an acceleration depression amount ACCP derived using a detection signal of the accelerator position sensor 27, or the like.

The ECU 5 drives and controls the fuel injection valve 4 based on the final fuel injection amount Qfin calculated in the above described calculation processing, whereby the fuel amount injected from the fuel injection valve 4 is controlled. The fuel amount (fuel injection amount) injected from the fuel injection valve 4 is determined by the fuel pressure within the delivery pipe 106 and a fuel injection time. Accordingly, in order to appropriately set the fuel injection amount, it is necessary to maintain the fuel pressure at an appropriate value. To achieve this, the ECU 5 performs feedback control of the fuel discharge amount of the high pressure fuel pump 103 such that an actual fuel pressure P derived from the detection signal of the fuel pressure sensor 161 converges on a target fuel pressure P0 set in accordance with the engine operating state. As a result, the fuel pressure is maintained at an appropriate value. Note that, the fuel discharge amount of the high pressure fuel pump 103 is feedback controlled by adjusting the valve closed period (the valve close start time) of the solenoid spill valve 133 based on the pump duty DT, as will be described hereinafter.

Pump Duty Calculation

Next, a calculation routine for calculating the pump duty DT that is performed by the ECU 5 will be described with reference to a flow chart shown in FIG. 5. This pump duty calculation routine is executed by interrupt processing that is performed at a predetermined time interval.

First, the pump duty DT is calculated in the processing of step S104 based upon Equation (1) below:

$$DT=FF+DTp+DTi \quad (1)$$

where, FF is a feed forward term, DTp is a proportional term, and DTi is an integral term.

In Equation (1), the feed forward term FF is a term that rapidly causes the actual fuel pressure P to converge on the target fuel pressure P0 even when the target fuel pressure P0 or the load factor KL have changed transiently by causing supply in advance of a fuel amount that matches a required fuel injection amount to the delivery pipe 106. This feed forward term FF is calculated by the processing in step S101.

Further, in Equation (1), the proportional term DTp is a term that causes the actual fuel pressure P to converge on the target fuel pressure P0. The integral term DTi is a term that causes variations in the pump duty DT resulting from fuel leaks, individual difference of the high pressure fuel pump 103, etc. to be suppressed. The proportional term DTp is calculated by the processing of step S102, and the integral term DTi is calculated by the processing of step S103.

The ECU 5 controls an energization start time for the magnetic solenoid valve 133*a* of the solenoid spill valve 133, namely, the valve close start time of the solenoid spill valve 133 based on the pump duty DT calculated using Equation (1). As a result of controlling the valve close start time of the solenoid spill valve 133 in this manner, the valve closed period of the solenoid spill valve 133 is changed, whereby the fuel discharge amount of the high pressure fuel pump 103 is adjusted and the actual fuel pressure P is changed such that it converges on the target fuel pressure P0.

Next, each step of the procedure of the pump duty calculation routine will be explained.

In the processing of step S101, the ECU 5 calculates the feed forward term FF based on the engine operating state, such as the final fuel injection amount Qfin and the engine rotation number NE. This feed forward term FF has a value that becomes larger as the required fuel injection amount increases. The feed forward term FF causes the pump duty DT to change toward 100%, namely, causes the fuel discharge amount of the high pressure fuel pump 103 to change toward a larger amount.

In the processing of step S102, the ECU 5 calculates the proportional term DTp using Equation (2) below, based on the actual fuel pressure P and the target fuel pressure P0, etc.:

$$DTp=K1\cdot(P0-P) \quad (2)$$

where, K1 is a coefficient.

As can be understood from Equation (2), the actual fuel pressure P has a value that is smaller than that of the target fuel pressure P0. As the deviation therebetween, [P0−P], becomes a larger value, the proportional term DTp becomes a larger value, thereby causing the pump duty DT to change toward 100%, namely, causing the fuel discharge amount of the high pressure fuel pump 103 to change toward a larger amount.

In the processing of step S103, the ECU 5 calculates the integral term DTi. The integral term DTi is calculated, for example, using Equation (3) below, based on the integral term DTi for the previous time, the actual fuel pressure P, and the target fuel pressure P0:

$$DTi=DTi+K2\cdot(P0-P) \quad (3)$$

where, K2 is a coefficient.

As can be understood from Equation (3), while the actual fuel pressure P has a smaller value than the target fuel pressure P0, a value corresponding to the deviation therebetween, [P0−P], is added to the integral term DTi at each predetermined time interval. As a result, the integral term DTi is updated such that it gradually changes to a higher value, whereby the pump duty DT is gradually changed toward 100% (namely, the fuel discharge amount of the high pressure fuel pump 103 is gradually changed to a larger amount). On the other hand, while the actual fuel pressure P has a value that is larger than the target fuel pressure P0, the value that corresponds to the deviation therebetween, [P0−P], is removed from the integral term DTi at each predetermined time interval. As a result, the integral term DTi is updated such that it gradually changes to a lower value, whereby the pump duty DT is gradually caused to change toward 0% (namely, the fuel discharge amount of the high pressure fuel pump 103 is gradually changed to a smaller amount).

In the processing of step S104, the ECU 5 calculates the pump duty DT using Equation (1). Next, in the processing of step S105, the ECU 5 performs the upper-lower limit guard processing so that the pump duty DT does not become less than 0% or more than 100%. Then, the ECU 5 terminates the pump duty calculation routine once.

Integral Term Update Determination Control

Next, an integral term update determination control will be explained.

First, the approach used in the technology of the related art will be described. If a change amount of the target fuel pressure P0 changes rapidly and the deviation of the target fuel pressure P0 and the actual fuel pressure P has become transiently larger in the fuel injection control of the engine 1, the actual fuel pressure P is caused to track the target fuel pressure P0 due to addition of the proportional term and the integral term in the feedback control. However, even if the pump duty DT is calculated from the target fuel pressure P0 and the actual fuel pressure P, there is a delay until when the high pressure fuel pump 103 is actually driven and the fuel discharged. If the timing of the next pump duty calculation occurs during this delay, the integral term DTi of the feedback control increases.

Figure 3:
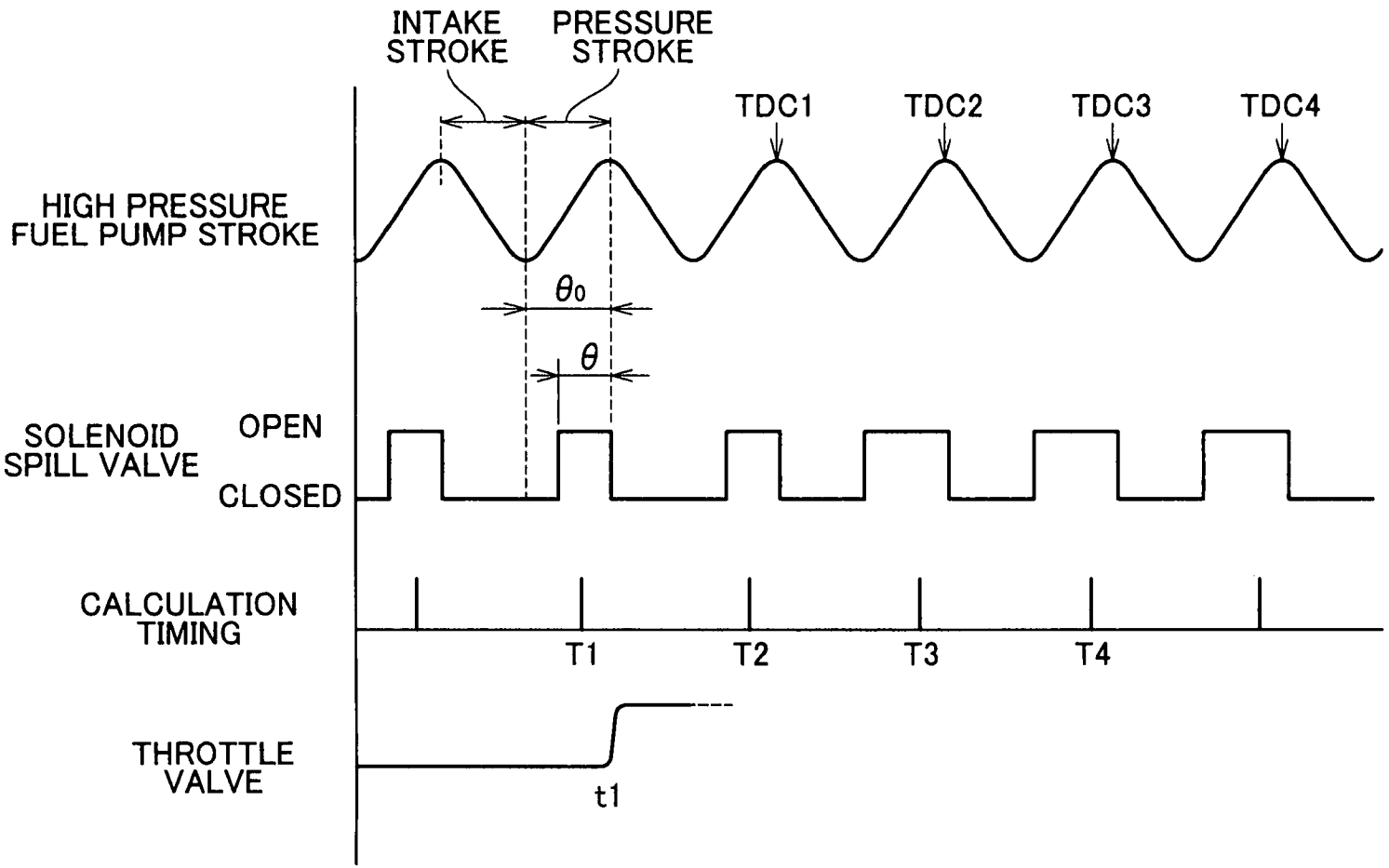
FIG. 3 is a timing chart showing, for example, an opening and closing operation of a solenoid spill valve, and a calculation timing of a pump duty.

As shown in FIG. 3, for example, if the pump duty DT is calculated at calculation timings T1, T2, etc., the discharge at the pump duty DT calculated at calculation timing T1 is ended at pump TDC 1 (piston top dead center of the high pressure fuel pump 103). Accordingly, there is a delay from the when the pump duty DT is calculated at calculation timing T1 until when the fuel is actually discharged. Thus, for example, if at time point t1 immediately after the calculation timing T1 the opening degree of the throttle valve 24 is changed such that target fuel pressure P0 becomes transiently larger, the next calculation timing T2 is before the pump TDC 1. Accordingly, at the time of the calculation performed at the calculation timing T2, the actual fuel pressure P is not increasing, and the deviation between the actual fluid pressure P and the target fluid pressure P0 becomes larger. Thus, the integral term DTi used in the feedback control increases. As a result, overshoot in which the actual fuel pressure P exceeds and increases above the target fuel pressure P0 may occur, and the combustion condition of the engine 1 may deteriorate.

Moreover, the fuel injection cycle is set to be shorter than the cycle of the discharge stroke of the high pressure fuel pump 103. As a result, even if the target fuel pressure P0 is a constant value, the actual fuel pressure P may sometimes reduce substantially due to fluctuations in load. If this reduction in the actual fuel pressure P occurs, for example, at the time point t1 immediately after the calculation timing T1 shown in FIG. 3, the change in the load (the reduction in the fuel pressure P) is included in the calculation of the pump duty DT at calculation timing T2. Accordingly, in this case, the deviation between the actual fuel pressure P and the target fuel pressure P0 increases, and overshoot may occur in which the integral term DTi of the feedback control increases.

However, in this embodiment, when the target fuel pressure P0 or the load factor KL has transiently changed, the integral term DTi of the feedback control is prohibited from being needlessly updated. Accordingly, overshoot is suppressed, and the combustion condition of the engine 1 is favorably maintained.

Next, a specific example of this control will be explained with reference to the flow chart shown in FIG. 6. The integral term update determination control routine shown in FIG. 6 is executed each time the pump duty calculation routine shown in FIG. 5 proceeds to step S103 (calculation of the integral term DTi).

In the integral term update determination control routine, the processing of step S203 calculates (updates) the integral term DTi based upon Equation (3). Further, in the processing of steps S201 and S202, it is determined whether updating of the integral term DTi should be stopped or not based upon Equation (3).

In this example of the integral term update determination control routine, the ECU 5 determines in the processing of step S201 whether (i) a transient change amount of the target fuel pressure P0 (dlprreq) is equal to or above a target fuel pressure change amount upper determination value (DL- PRH) (a condition J1 that, dlprreq≧DLPRH), or whether (ii) a transient change amount of the load factor KL (dlklfwd) is equal to or above a load factor change upper determination value (DLKLH) (a condition J2 that, dlklfwd≧DLKLH).

If the determination of step S201 is negative, namely, if the transient change amount of the target fuel pressure P0 (dlprreq) is less than the target fuel pressure change amount upper determination value (DLPRH), and the transient change amount of the load factor KL (dlklfwd) is less than the load factor change amount upper determination valve (DLKLH), the routine proceeds to step S203. Then, the integral term DTi is updated based upon Equation (3). Next, the ECU 5 terminates the integral term update determination control routine once, and returns to the processing of the pump duty calculation routine (FIG. 5).

If the determination of step S201 is positive, namely, when [dlprreq≧DLPRH] or [dlklfwd≧DLKLH], the routine proceeds to step S202. In step S202, after it has been determined that [dlprreq≧DLPRH] or after it has been determined that [dlklfwd≧DLKLH], it is determined whether fuel discharge in accordance with the calculated pump duty DT has been completed or not.

If the determination of step S202 is positive, the routine proceeds to step 203 where the integral term DTi is updated based on Equation (3). Following this, the ECU 5 terminates the integral term update determination control routine once, and returns to the processing of the pump duty calculation routine (FIG. 5).

Figure 5:
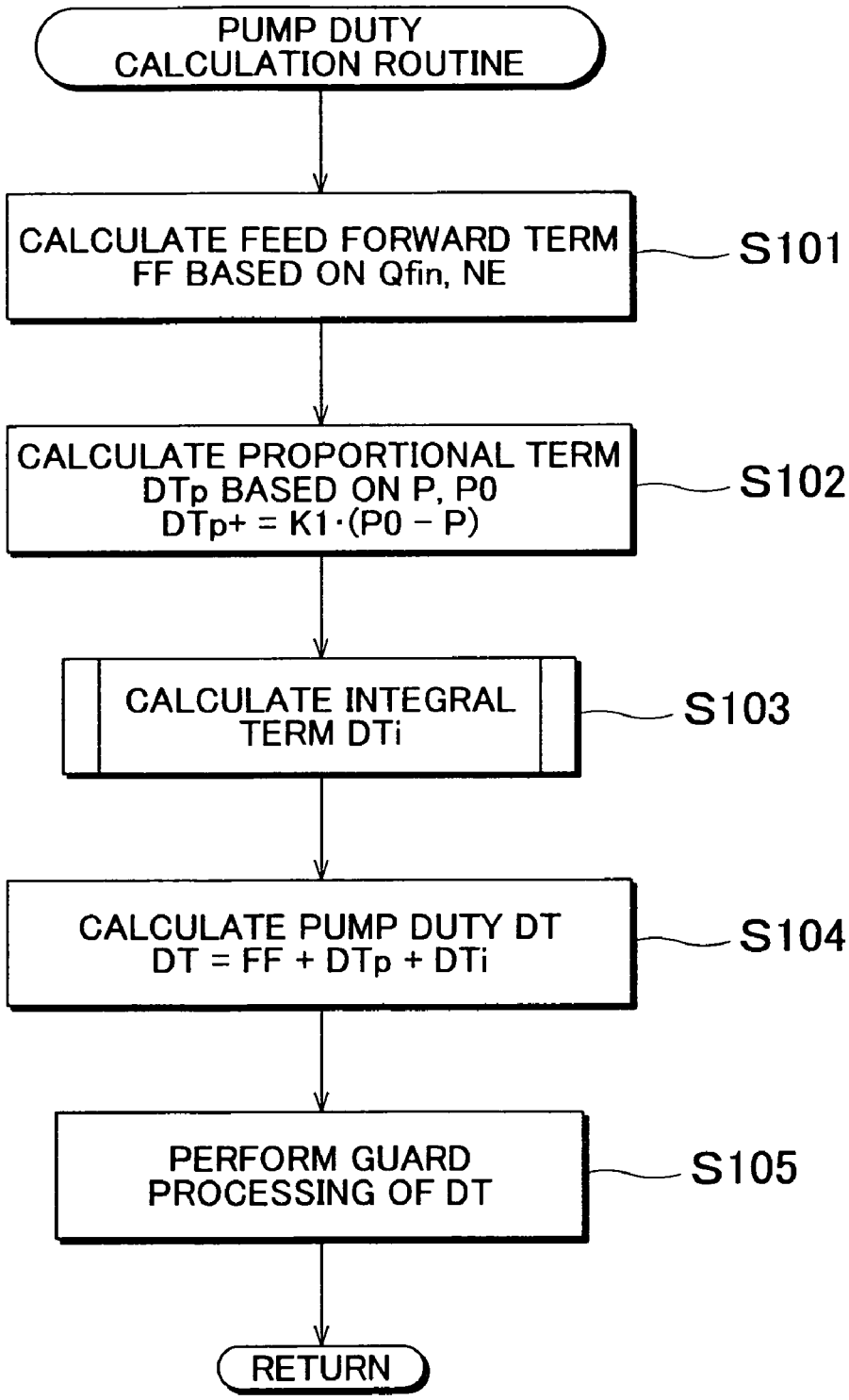
FIG. 5 is a flow chart shown a calculation routine for the pump duty.
Figure 6:
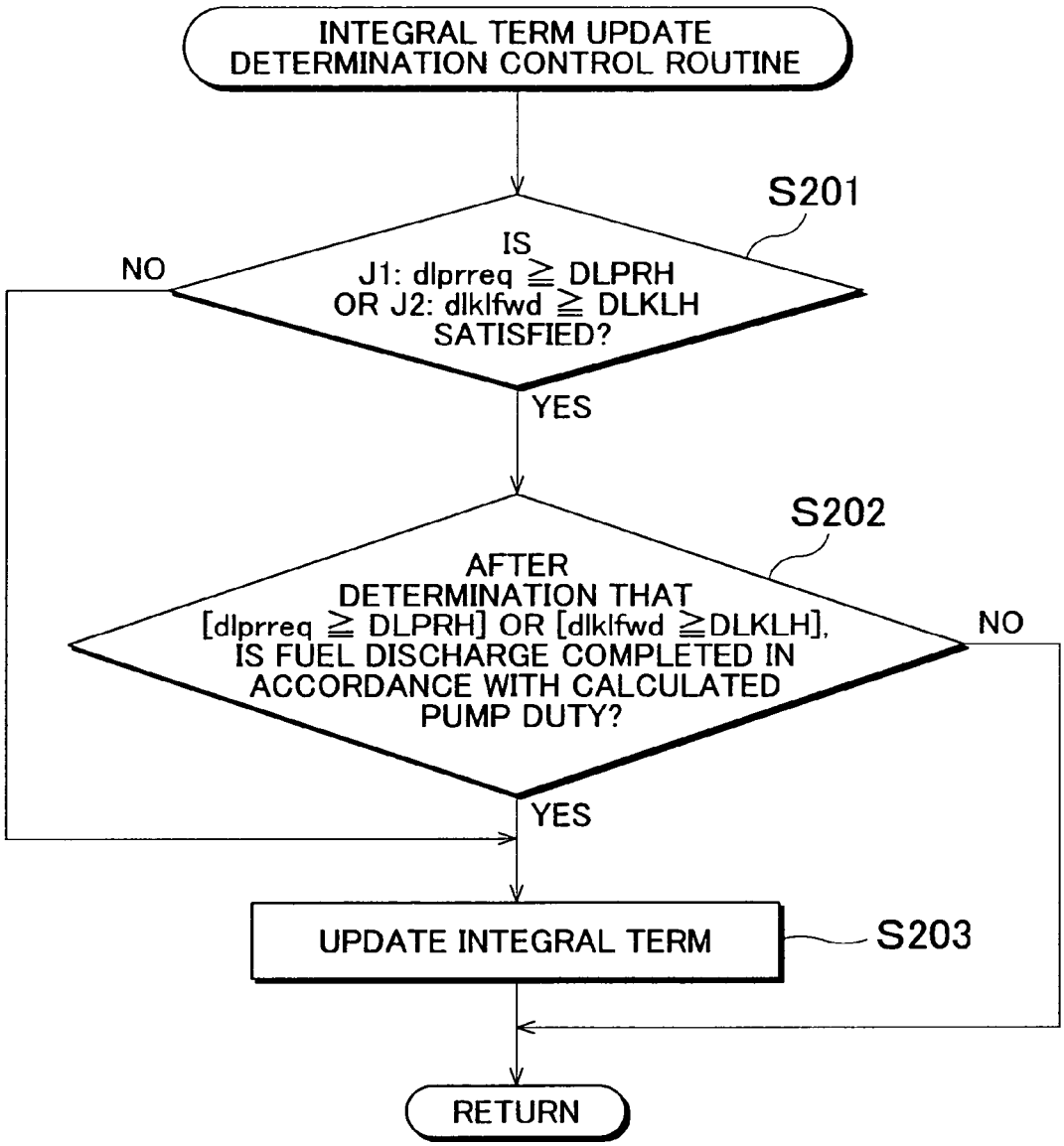
FIG. 6 is a flow chart showing an example of processing details of an integral term update determination control.

On the other hand, if the determination of step S202 is negative, the ECU 5 does not update the integral term DTi, and terminates the integral term update determination control routine once, and returns to the processing of the pump duty calculation routine (FIG. 5).

The processing of steps S201 to S203 stops updating of the integral term DTi of the feedback control when transient change of the target fuel pressure P0 or the load factor KL has occurred. Update is stopped until completion of the fuel discharge that accords with the pump duty DT that was calculated when the transient change of the target fuel pressure or the load factor KL occurred. Accordingly, when the target fuel pressure P0 and/or the load factor KL have transiently changed, namely, when the deviation of the target fuel pressure P0 and the actual fuel pressure P has become transiently larger, needless updating of the integral term DTi can be inhibited, whereby it is possible to suppress the occurrence of fuel pressure overshoot.

Next, the timing of return to integral term update in this example of the integral term update control will be explained with reference to FIG. 3. If the target fuel pressure P0 (or the load factor KL) has transiently become larger, for example, at time point t1 immediately after the calculation timing T1, the transient change of the target fuel pressure P0 will be included in the calculation at calculation timing T2. The timing of the return to integral term update will be after when the discharge that reflects the pump duty DT calculated at calculation timing T2 is completed. However, at the time of calculation timing T3, the discharge (pump TDC 2 discharge) that reflects the pump duty DT calculated at calculation timing T2 is not yet completed. Thus return to updating of the integral term DTi takes place at the next calculation timing, namely, calculation timing T4.

Next, a more detailed description will be given about the determination conditions for stopping integral term update (the conditions used in the determination processing of step S201), namely, the target fuel pressure change amount upper determination value (DLPRH) condition J1, and the load factor change upper determination value (DLKLH) condition J2. For determination values (for example, DLPRH=4 MPa, and, for example, DLKLH=50%) of the conditions J1 and J2, it is possible to use threshold values that make it possible to suppress overshoot. These threshold values may be based on results for values that have been established using calculation in advance, experimentation, or the like, in the following manner. Namely, in the case that, for example, the target fuel pressure P0 or the load factor KL have transiently changed, if the integral term DTi tracks this change, the values are ones at which overshoot definitely occurs after the actual fuel pressure P has reached the target fuel pressure P0.

Another Example of Integral Term Update Determination Control

Hereinafter, another example of the integral term update determination control will be explained with reference to the flow chart of FIG. 7.

Figure 7:
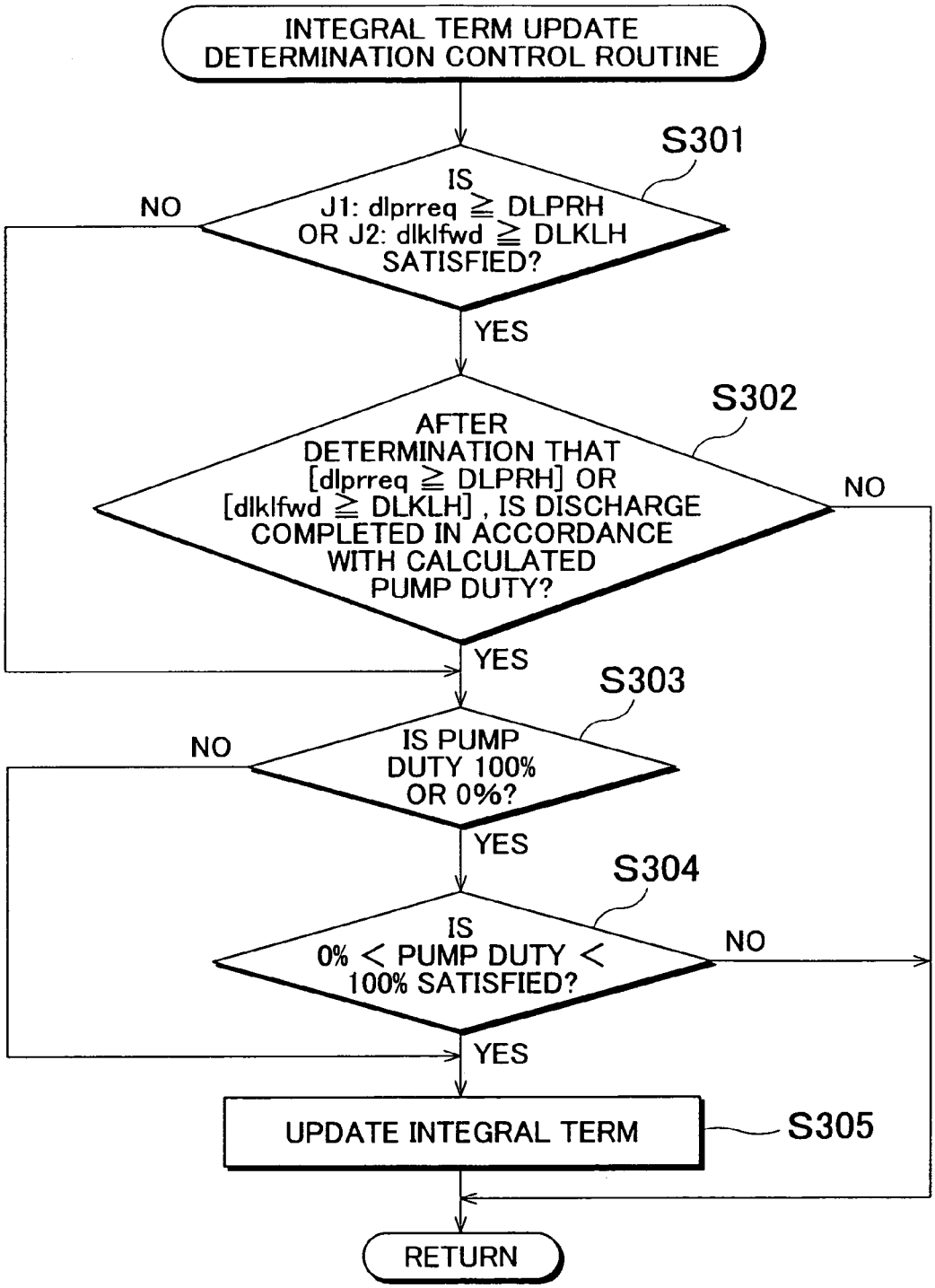
FIG. 7 is a flow chart showing another example of processing details of the integral term update determination control.

The integral term update determination control routine shown in FIG. 7 is executed each time the pump duty calculation routine shown in FIG. 5 proceeds to step S103 (calculation of the integral term DTi).

In the integral term update determination control routine, the processing of step S305 calculates (updates) the integral term DTi based upon Equation (3). Further, in the processing of steps S301 to S304, it is determined whether updating of the integral term DTi should be stopped or not based upon Equation (3).

In this example of the integral term update determination control routine, the respective processing performed in steps S301 and S302 are fundamentally the same as those performed in steps S201 and S202 of the flow chart of FIG. 6. In the case that the determination of step S301 is negative, namely, if (i) the transient change amount of the target fuel pressure P0 (dlprreq) is less than the target fuel pressure change amount upper determination value (DLPRH) and (ii) the transient change amount of load factor KL (dlklfwd) is less than the load factor change upper determination value (DLKLH), the routine proceeds to step S303.

If the determinations of steps S301 and S302 are both positive, namely, if it is determined that [dlprreq≧DLPRH] or [dlklfwd≧DLKLH], and that fuel discharge in accordance with the pump duty DT calculated after this determination has been completed, the routine proceeds to step S303. Note that, if the determination of step S302 is negative, the ECU 5 terminates the integral term update determination control routine once without updating the integral term DTi. The ECU 5 then returns to the processing of the pump duty calculation routine (FIG. 5).

In the processing of step S303, the ECU 5 determines whether the pump duty DT is 0% or 100%. Then, in the processing of step S304, the ECU 5 determines whether the pump duty DT satisfies, [0%<DT<100%].

In the case that the determinations of steps S303 and S304 are both positive, the routine proceeds to step S305. Further, in the case that the determination of step S303 is negative, the routine proceeds to step S305. In the processing of step S305, the ECU 5 updates the integral term DTi based on Equation (3). Following this, the ECU 5 terminates the integral term update determination control routine once, and returns to the processing of the pump duty calculation routine (FIG. 5).

On the other hand, if the determination of step S303 is positive and the determination of step S304 is negative, the ECU 5 terminates the integral term update determination control routine once without updating the integral term DTi. The ECU 5 then returns to the processing of the pump duty calculation routine (FIG. 5).

According to the integral term update determination control of FIG. 7 described above, if transient change of the target fuel pressure P0 or the load factor KL has occurred, updating of the integral term DTi is stopped until completion of the fuel discharge in accordance with the pump duty DT calculated when the target fuel pressure P0 or the load factor KL transiently changed. Accordingly, even if the target fuel pressure P0 or the load factor KL have transiently changed, it is possible to inhibit the integral term DTi from being needlessly updated and suppress the occurrence of fuel pressure overshoot.

Further, when the pump duty DT is 0% or 100%, updating of the integral term DTi is definitely prohibited. Accordingly, when the upper-lower limit guard processing (the processing of step S105 of the pump duty calculation routine (FIG. 5)) is being performed, if the pump duty DT has become equal to either the upper limit (100%) or the lower limit (0%) of the guard, the integral term DTi of the feedback control is not needlessly updated. Thus, it is possible to reduce fuel pressure overshoot when the pump duty DT satisfies, 0%<DT 100%.

In the above described embodiment, the invention is applied to an in-cylinder direct injection four cylinder gasoline engine. However, this is merely an example, and the invention may be applied without limitation to gasoline engines with any chosen number of cylinders, such as, for example, an in-cylinder direct injection six cylinder gasoline engine. Further, the invention is not limited to being applied to a gasoline engine, and may be applied to fuel injection control in other types of internal combustion engine such as a diesel engine.

The invention addresses the problem that, in a fuel injection control for a direct injection internal combustion engine in which fuel is directly injected in to a combustion chamber, increase of an integral term occurs when a target fuel pressure, a load factor, or the like, has transiently changed when there is a delay from when a pump duty is calculated to when fuel discharge takes place. The invention can be favorably used to suppress the occurrence of fuel pressure overshoot.

What is claimed is:

1. A fuel injection control device for an internal combustion engine, the internal combustion engine being a direct injection internal combustion engine, comprising:

a feedback control unit that performs feedback control of a discharge amount of a high pressure fuel pump such that an actual fuel pressure becomes a target fuel pressure, the feedback control using a control operation including an integral term;

an integral term update control unit that stops updating of the integral term of the feedback control when a deviation of the target fuel pressure and the actual fuel pressure is equal to or more than a predetermined value; and a calculation unit that calculates a pump duty that is a controlled variable of the feedback control of the high pressure fuel pump based upon the deviation of the target fuel pressure and the actual fuel pressure, wherein after the integral term update determination control unit determines that the deviation between the target fuel pressure and the actual fuel pressure is equal to or more than the predetermined value, the integral term update determination control unit returns to updating of the integral term of the feedback control after completion of fuel discharge by the high pressure fuel pump in accordance with the pump duty calculated by the calculation unit.

2. The fuel injection control device for an internal combustion engine according to claim 1, wherein the integral term update unit stops updating of the integral term of the feedback control when at least one of a change amount of the target fuel pressure is equal to or more than a predetermined value, and a change amount of a load factor of the internal combustion engine is equal to or more than a predetermined value.

3. The fuel injection control device for an internal combustion engine according to claim 1, wherein the integral term update determination control unit prohibits updating of the integral term of the feedback control when the pump duty is 0% or 100%.

4. The fuel injection control device for an internal combustion engine according to claim 1, wherein a fuel injection cycle is shorter than a cycle of a discharge stroke of the high pressure fuel pump.

5. A fuel injection control device for an internal combustion engine, the internal combustion engine being a direct injection internal combustion engine, comprising:

feedback control means for performing feedback control of a discharge amount of a high pressure fuel pump such that an actual fuel pressure becomes a target fuel pressure, the feedback control using a control operation including an integral term;

integral term update control means for stopping update of the integral term of the feedback control when a deviation of the target fuel pressure and the actual fuel pressure is equal to or more than a predetermined value; and a calculation unit that calculates a pump duty that is a controlled variable of the feedback control of the high pressure fuel pump based upon the deviation of the target fuel pressure and the actual fuel pressure, wherein after the integral term update determination control unit determines that the deviation between the target fuel pressure and the actual fuel pressure is equal to or more than the predetermined value, the integral term update determination control unit returns to updating of the integral term of the feedback control after completion of fuel discharge by the high pressure fuel pump in accordance with the pump duty calculated by the calculation unit.

6. The fuel injection control device for an internal combustion engine according to claim 5, wherein the integral term update determination control unit prohibits updating of the integral term of the feedback control when the pump duty is 0% or 100%.

7. A fuel injection control method for an internal combustion engine, the internal combustion engine being a direct injection internal combustion engine, comprising the steps of:

performing feedback control of a discharge amount of a high pressure fuel pump such that an actual fuel pressure becomes a target fuel pressure, the feedback control using a control operation including an integral term;

stopping update of the integral term of the feedback control when a deviation of the target fuel pressure and the actual fuel pressure is equal to or more than a predetermined value, and a calculation unit that calculates a pump duty that is a controlled variable of the feedback control of the high pressure fuel pump based upon the deviation of the target fuel pressure and the actual fuel pressure, wherein after the integral term update determination control unit determines that the deviation between the target fuel pressure and the actual fuel pressure is equal to or more than the predetermined value, the integral term update determination control unit returns to updating of the integral term of the feedback control after completion of fuel discharge by the high pressure fuel pump in accordance with the pump duty calculated by the calculation unit.

8. The fuel injection control device for an internal combustion engine according to claim 7, wherein the integral term update determination control unit prohibits updating of the integral term of the feedback control when the pump duty is 0% or 100%.

* * * * *